US006000897A

United States Patent [19]

DesJarlais

[11] Patent Number: 6,000,897

[45] Date of Patent: Dec. 14, 1999

[54] BOOKBINDING COIL INSERTION MACHINE

[76] Inventor: Matthew G. DesJarlais, 11 Durand Rd., Winnipeg, Manitoba, Canada, R2J 3T1

[21] Appl. No.: 09/078,014

[22] Filed: May 13, 1998

[51] Int. Cl.[6] ..... B42B 9/00; B42B 5/10; B42B 5/12

[52] U.S. Cl. ..... 412/40; 412/38; 412/39; 140/92.3

[58] Field of Search ..... 412/38, 39, 40; 140/92.3

[56] References Cited

U.S. PATENT DOCUMENTS 4,378,822 4/1983 Morris ..... 140/92.3
5,785,479 7/1998 Battisti et al. ..... 412/39
5,890,862 4/1999 Spiel et al. ..... 412/40

*Primary Examiner*—Willmon Fridie, Jr.
*Assistant Examiner*—Mark T. Henderson
*Attorney, Agent, or Firm*—Adrian D. Battison; Murray E. Thrift

[57] ABSTRACT

This invention relates to a machine for insertion of plastic helical bookbinding coils in the aligned holes at the edge of a book for binding the book. The machine comprises a platen for receiving the collated book; a coil engagement roller for engaging the coil at the edge of the platen and a coil drive roller for rotating the helical coil.

18 Claims, 8 Drawing Sheets

BOOKBINDING COIL INSERTION MACHINE

This invention relates to a machine for insertion of plastic helical bookbinding coils in the aligned holes at the edge of a book for binding the book.

BACKGROUND OF THE INVENTION

It is well known that collated books are often bound using a helical coil which passes through aligned holes at one edge of the book. This provides a book which can be easily opened and held at an opened position and is therefore particularly effective for manuals and reference materials.

The helical coil at the edge of the book can be formed from a coiled wire or a coiled strip of plastic material. The coiled wire has the significant advantage that it can be more easily inserted. The helical plastic coil has the advantages that it can be manufactured in different colours and therefore provides a particularly attractive appearance as opposed to the strictly utilitarian appearance of the steel wire.

The major disadvantage of the plastic coil is that it is necessarily thicker and the surface is more resistant to insertion into the aligned holes at the edge of the book so that the plastic coil is significantly more difficult to insert.

This difficulty in insertion has led firstly to an inability to automate the process so that it is normally carried out by hand. Secondly, this difficulty in insertion has led to resistance by the trade binderies to the use of plastic coil due to the difficulty in finding effective skilled labour that can carry out the insertion at a reasonable cost.

Up until now, therefore, there has been no effective commercial machine which provides automation of the insertion process.

SUMMARY OF THE INVENTION

It is one object of the present invention to provide a machine for inserting plastic pre-formed helical coils into the aligned holes at an edge of a collated book for binding the book.

According to a first aspect of the invention, the machine comprises:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of the helical coil along the platen into engagement with the edge of the book and into the aligned holes;

an end stop for halting movement of the coil when inserted such that ends of the coil are exposed at respective ends of the edge of the book;

and end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

the platen being arranged such that the edge thereof is a bottom edge and such that the platen is inclined upwardly and rearwardly from the drive roller.

Preferably the machine includes at least two spine former members at the edge of the platen onto which the edge of the book is placed for support by the spine former member, the spine former member having a width in a direction along the edge which is no wider than spaces between the turns of the coil so as to allow the coil to pass on either side of the member as the coil is driven along the edge substantially without distorting the coil.

Preferably the spine former member is twisted in a direction along the edge to an angle substantially equal to the pitch of the coil.

Preferably the spine former member includes a support surface for the edge of the book which is arched to form the edge onto a concave shape approximately matching the curvature of the coil.

Preferably the spine former member includes a guide surface opposed to the platen to guide the book edge as it slides down the platen onto the support surface.

Preferably there is provided a clamp member opposed to the platen for clamping the book between the clamp member and the platen, the clamp member being located above the spine former member, the clamp member being movable relative to the platen between a first clamp position for clamping the book onto the platen, a second guide position spaced for engaging the book as it slides down between the platen and the clamp member and guiding the edge of the book onto the spine former member and a third release position spaced from the platen by a distance sufficient to release the book for removal of the book and the inserted coil from the platen.

Preferably the clamp member comprises a bar having an edge substantially aligned with the edge of the platen, the edge of the bar having a guide comb for guiding movement of the coil.

Preferably the comb guide at the edge of the platen has a space at the spine former member into which the spine former member fits for guiding the coil along the comb guide.

Preferably the platen includes a hole therein into which an operator can place the hand for manipulating the book on the platen.

Preferably the platen is inclined at an angle of the order of 40 degrees upwardly and rearwardly from the bottom edge thereof.

Preferably the platen is adjustable to accommodate different thickness of book by movement of the platen horizontally away from the drive roller and by adjustment of the angle of inclination thereof.

Preferably the end cutting members are mounted on a shaft at a height below and parallel to the edge of the platen for pivotal movement from a retracted position into engagement with the coil after insertion.

According to a second aspect of the invention the machine comprises:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of the helical coil along the platen into engagement with the edge of the book and into the aligned holes;

an end stop for halting movement of the coil when inserted such that ends of the coil are exposed at respective ends of the edge of the book;

and end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

the coil drive roller being located at a position spaced along the edge of the platen from the edge of the book such that a forward end of the coil is free from the drive roller when it engages the end of the edge of the book.

Preferably there is provided an assisting drive member for engaging and driving the coil while partly engaged into the edge of the book at a position on the coil at the edge of the book, the assisting drive member comprising at least one intermittent engagement member arranged for rotation about an axis parallel to and adjacent to the coil so as to intermittently contact the coil in a slapping action.

Preferably there are at least two intermittent engagement members at spaced positions along the edge of the book.

Preferably the intermittent engagement member comprises a flap member.

Preferably the intermittent engagement member is mounted on a common shaft with the drive roller.

Preferably there is provided a bridge member for supporting the coil in movement from the drive roller to the end of the edge of the book, the bridge member being retractable to allow access by the end cutting member to the coil at said end of the edge of the book when the coil is inserted.

Preferably there is provided a pressure member for engaging the coil at the drive roller for pressing the coil into engagement with the drive roller and the engagement roller for driving thereby, the pressure member being retractable to allow the coil to be inserted into the required position for driving.

Preferably forward movement of the pressure member toward the drive roller is controlled to prevent excess compression of the coil at the end causing distortion thereof.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
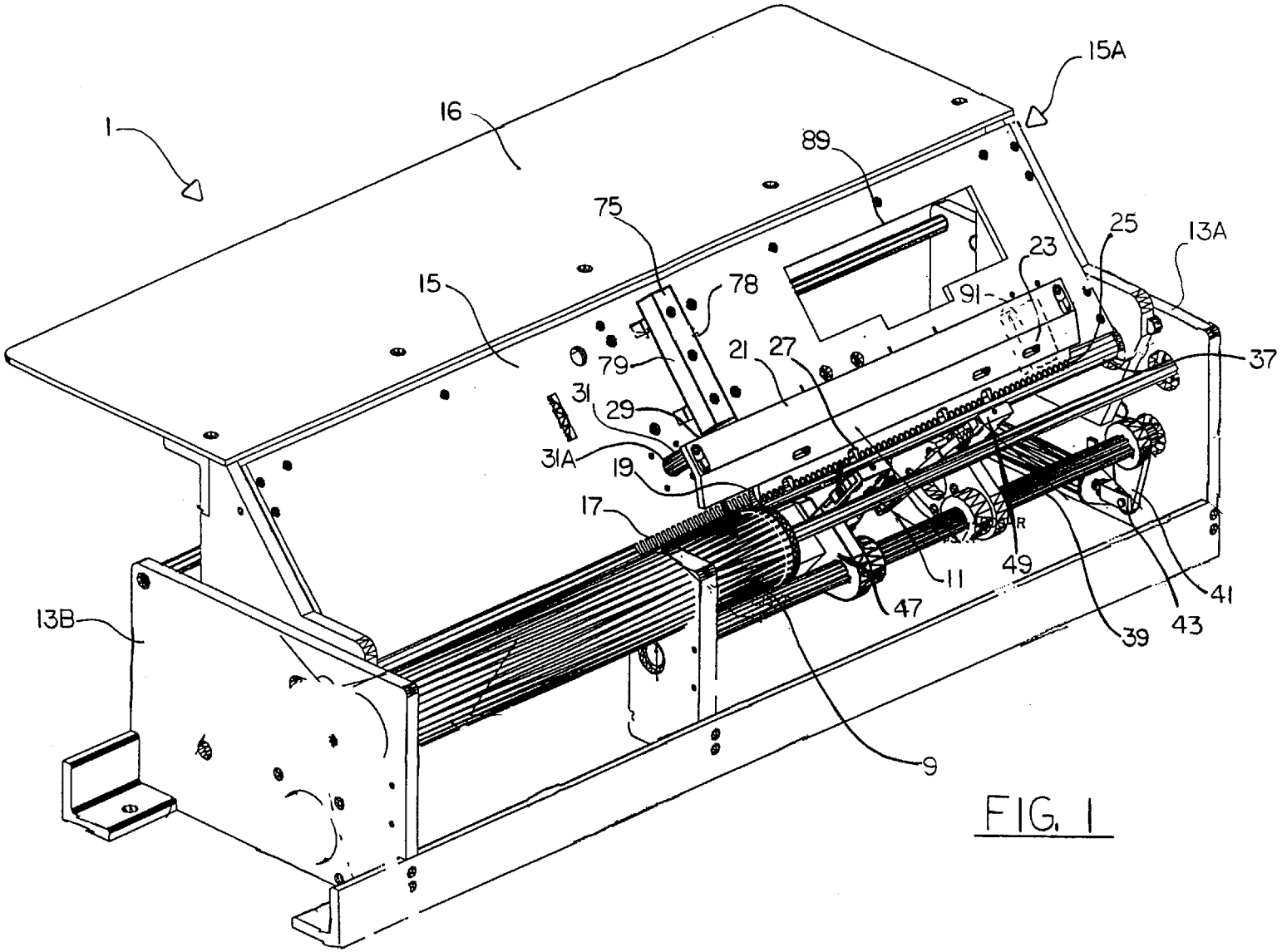
FIG. 1 is an isometric view of the machine.
Figure 2:
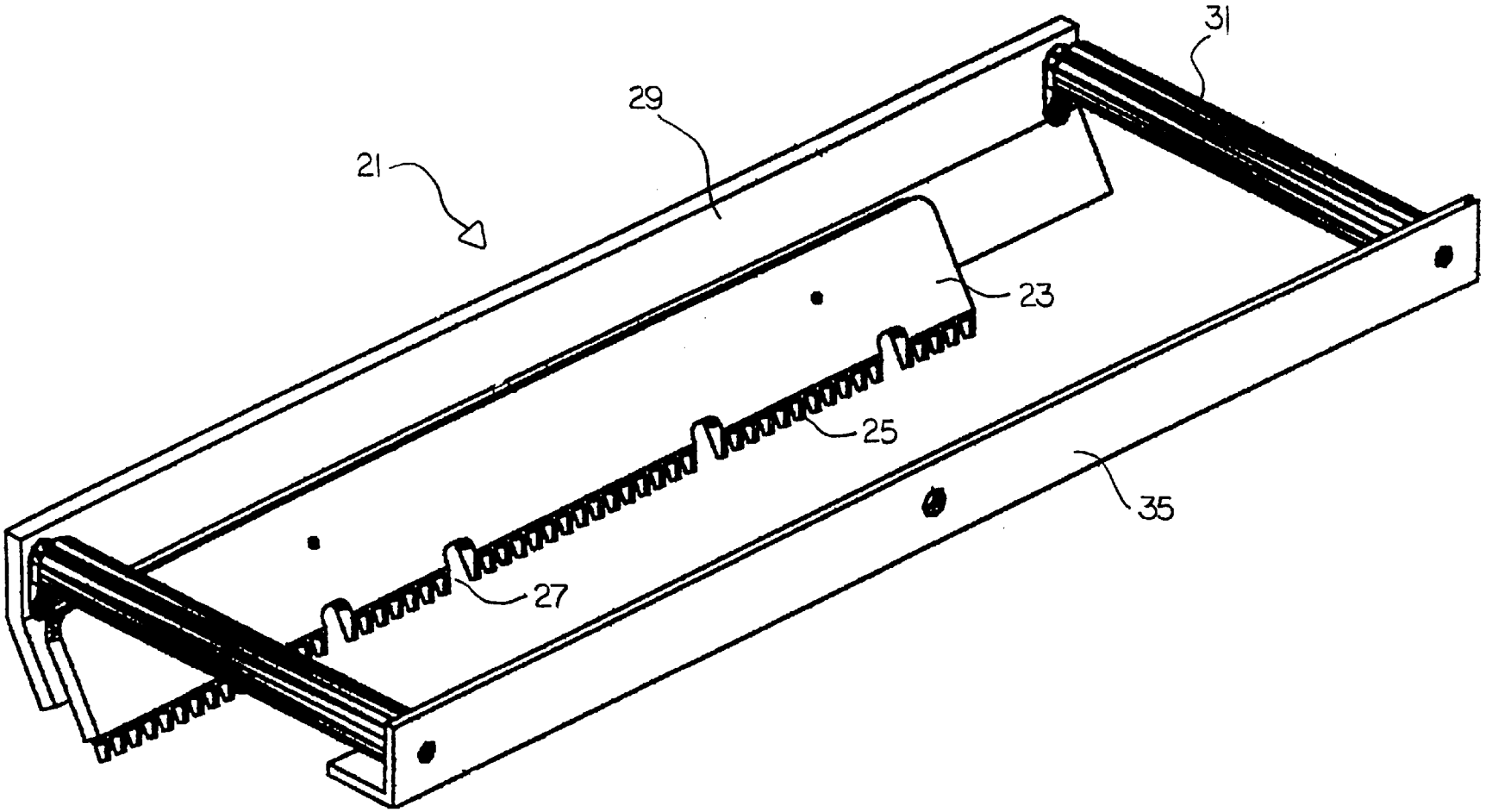
FIG. 2 is an isometric view of the book clamp.

A machine 1 for inserting plastic pre-formed helical coils 3 into aligned holes 5 at an edge of a collated book 7 for binding has a rubber roller 9. The rubber roller 9 is elongated horizontal tube that is situated so that the rubber roller 9 rotates and moves the coil 3 in a forward direction to be inserted into the aligned holes 5 of the book 7. The rubber roller 9 has a drive roller shaft 11. The drive roller shaft 11 extends horizontally from the rubber roller 9 to vertical side support walls 13A and 13B.

The book 7 is placed on a platen 15 which is located above the roller 9 and extends at an incline upwardly and rearwardly from the roller 9. At the bottom edge of the platen 15 is a comb 17 associated with the roller. The comb 17 has a plurality of teeth which are situated so that the comb 17 guides the coil 3 along the roller 9 into the aligned holes 5 of the book 7. The main platen comb 19 is located on the bottom edge of the platen 15 and is adjacent to the comb 17. The platen comb 19 has a plurality of teeth which are situated to guide the coil 3 into the aligned holes 5 of the book 7.

The platen 15 can be adjusted by the platen tilt device 71 which extends perpendicularly from the platen 15 in a rearward direction. The platen tilt device 71 is mounted on a platen tilt support 73. The platen 15 has a platen pivot 15A located at the top corner of the platen so that the platen 15 can be lifted upwards towards the horizontal top plate 16.

A book clamp 21 is mounted on the platen 15 and has a front end which is positioned horizontally parallel with the platen 15 and has an inclined front edge 23. The front edge 23 of the clamp 21 extends downwardly such that the front edge 23 corresponds with the bottom edge of the platen 15. The front edge 23 of the clamp 21 has a clamp comb 25. The clamp comb 25 is located at the furthermost bottom end of the front edge 23 of the clamp 21. The clamp comb 25 consists of a plurality of teeth and a plurality of wide spaced teeth 27. The book clamp 21 has a front support bracket 29 in which the front edge 23 of the clamp 21 is attached. The front support bracket 29 has a pair of horizontally extending clamp support arms 31. The clamp support arms 31 extend rearwardly through clamp arms holes 33 on the platen 15 to a clamp support bracket 35. The clamp support bracket 35 is located behind the platen 15 and is adjacent to the front support bracket 29. The clamp arms 31 are surrounded by compression springs 31A to offer resistance on the clamp arms 31.

A second drive roller 37 extends horizontally from the first vertical support wall 13 to a second vertical support wall 13A and rotates substantially parallel to the first drive roller 11. The second drive roller 37 is located behind the first drive roller 11 and slightly below. The second vertical side support wall 13A is located on the opposite end of the machine 1.

A rocker shaft 39 is located below and slightly behind the first drive roller 11. The rocker shaft has a pivot arm 41 which extends downwardly to a pivot 43. The pivot 43 is attached to an air cylinder actuator 45 which is arranged for movement of the pivot 43. As the pivot 43 is moved the pivot arm 41 rotates the rocker shaft 39. Located on the rocker shaft 39 is a pair of rocker arms 47 which extend upwardly and rearwardly and a cutting and bending head 49 is mounted on the ends of the rocker arms 47.

Mounted on the first drive roller 11 are first and second drive members 51. The drive members 51 are positioned so that they rotate around the first drive roller 11 intermittently. At the ends of the drive members 51 is a flap member 53.

A coil hold down member 55 is located on the platen 15. The coil hold down member 55 is positioned parallel to the platen 15 and extends downwardly. The coil hold down member 55 has a coil hold down arm 57 which is placed in a coil hold down air cylinder actuator 59. The coil hold down air cylinder actuator 59 allows the coil hold down arm 57 to move in and out. The coil hold down member 55 has a coil hold down roller 61 located on the furthermost bottom end of the coil hold down arm 57. The coil hold down roller 61 is a horizontal free rolling device which extends outward from respective sides of the coil hold down arm 57.

A coil support member 63 is located below the platen 15. The coil support member 63 extends upwardly. The coil support member 63 has a coil support arm 65 which is placed in a coil support air cylinder actuator 67. The coil support air cylinder actuator 67 allows the coil support arm 65 to move in and out. The coil support member 63 has a coil support end 69 which may include a roller located on the furthermost top end of the coil support arm 65. The coil support end 69 is a horizontal free rolling device which extends outward from respective sides of the coil support arm 65.

A side lay 75 is located on the platen 15 and is mounted on the platen 15 by a pair of allen screws 77. The side lay 75 which is a rectangular block which runs parallel with the platen 15 has a first side 78 designed with an angle of 80° and a second side 79 designed with an angle of 82°.

A first spine former 81A and a second spine former 81B are located at the bottom edge of the platen 15 curving around the platen comb 19. The spine former 81A and 81B have a mount portion 83 which is attached to the platen 15 through the spine former insert holes 85. The spine former 81A and 81B has an arched end 87 in which the edge of the book 7 with the aligned holes 5 is placed.

A book adjustment portion 89 is located on the platen 15. The book adjustment portion 89 is a rectangular hole which is situated so that the book 7 can be adjusted on the platen 15.

In operation, the plastic coil 3 is placed onto the platen 15 such that the coil rests on the rubber roller 9 and is guided by the combs 17. The book 7 is placed on the platen 15 such that it rests on the arched end 87 of the spine former 81A and 81B the book clamp 21 is arrangement in a position wherein the clamp comb is angled so that the book 7 is guided onto the spine formers by the book clamp and the book is pressed against the side lay 75 so that the book takes the appropriate shape. Then the operator presses the start button and the coil hold down mechanism 56 gently applies pressure on the coil and simultaneously the book clamp 21 presses on the book 5 to ensure that the book remains stable and the coil support 63 raises and engages the coil supporting the coil along the roller.

Then the start button is pressed again and the motor engages the first roller drive belt turning the first roller drive 11 and the second roller drive belt turning the second roller drive 37. The first roller drive 11 turns the rubber roller 9 and the second roller drive turns and together they cause the coil to advance towards the book. As the coil advances the coil hold down increases pressure.

As the coil is inserted through the aligned holes 5 of the book the platen combs 19 continue to guide the coil. The flap members 53 spin and engage the coil intermittently to assist the coil through the holes. As the coil has run past the coil hold down roller, the roller drops signalling the motor to stop.

When the coil is completed being inserted through the books aligned holes the coil support 63 releases pressure and drops away from the coil so that the cutting and bending heads 49 can be raised by the rocker shaft 49 and proceed to cut the ends of the coil and bend them simultaneously so that the coil remains in place.

When the book is bound the rocker shaft tilts the cutting and bending heads back to the start position, the book clamp releases and the book can now be removed.

In setting up the machine 1 the spine formers 81A and 81B are used to create a curvature to the binding edge of the book. The spine former must correspond to the diameter of coil 3 that is being used.

Before installing the spine formers 81A and 81B, you must first remove the front book clamp 21 so that the operator can access the platen 15 and the spine former insert positioning slots 85. The first spine former 81A is placed in the bind former insert 85 which is closest to the side lay 75. The position of the second spine former 81B will depend upon the dimensional size of the book 7. The second spine former 81A should be positioned as close to the outside right edge of the book as possible. The spine formers fit into the slots by first sliding up and in the top of the spine former, allowing a bottom portion to simply fall into place.

The side lay 75 has angles to create a slant to the pages of the book; simulating the angle of the coil 3. Creating this angle allows for easier coil insertion.

The operator must place a pre-punched back cover from the book in position on top of the spine formers. This sheet will act as a step up guide. The coil 3 is advanced so that the lead edge of the coil comes up to the edge of the positioned back cover. At this point horizontal adjustment of the side lay 75 and a platen 15 so that the coil 3 is able to wind into the first hole of the book. The lead edge of the coil 3 will enter the back of the book, running through the centre of that first hole.

The spine formers 81A and 81B must be shaped to make that the front edge of the spine formers do not obstruct any of the punched holes 5.

Figure 3:
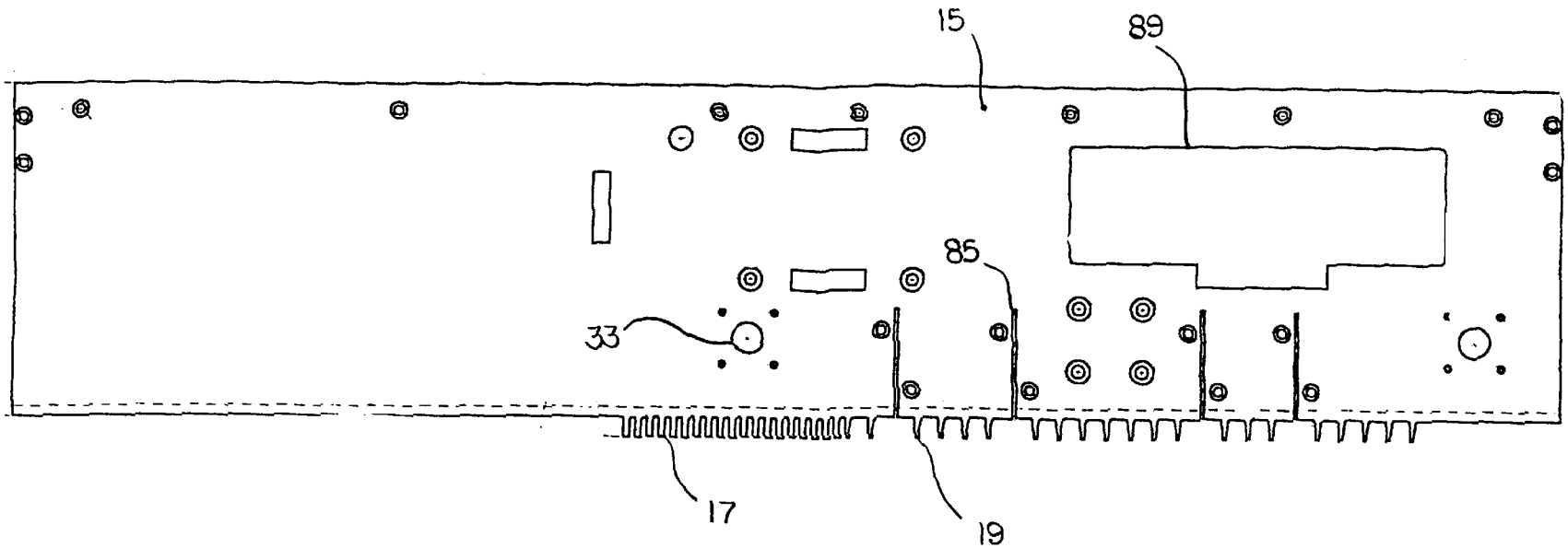
FIG. 3 is a front elevational view of the platen.
Figure 4:
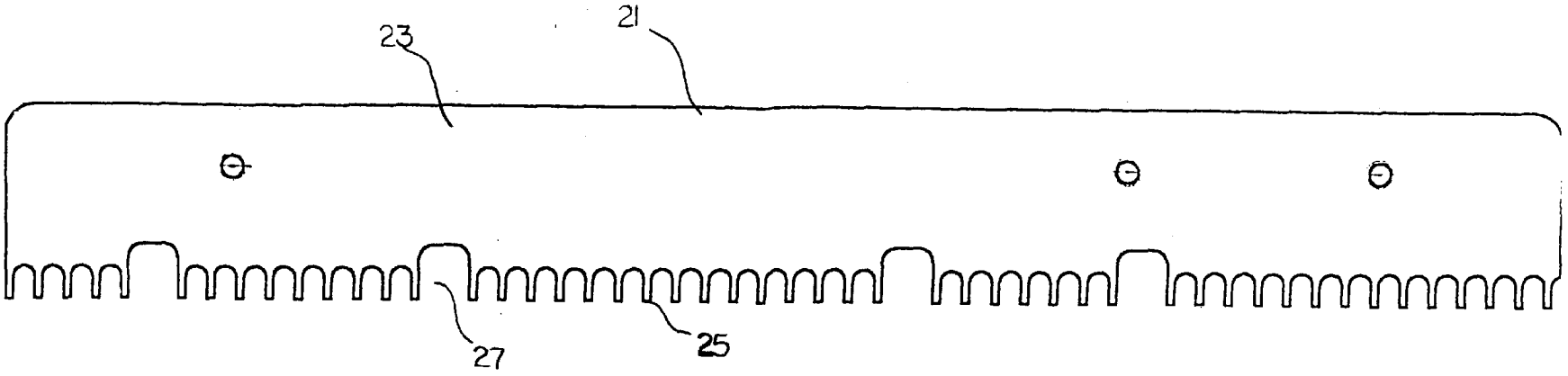
FIG. 4 is a front elevational view of the book clamp.
Figure 5:
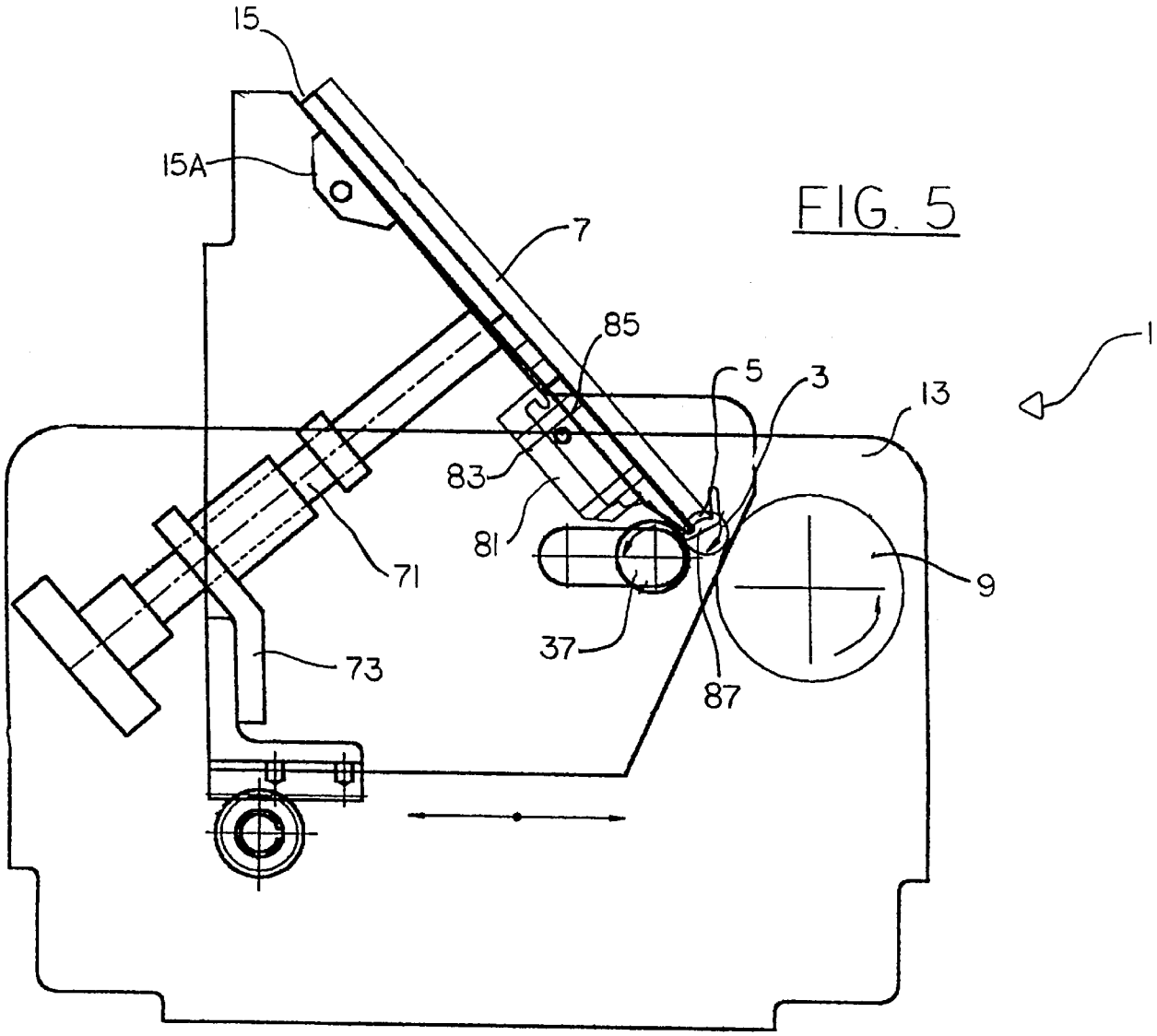
FIG. 5 is a vertical cross section of the platen.
Figure 6:
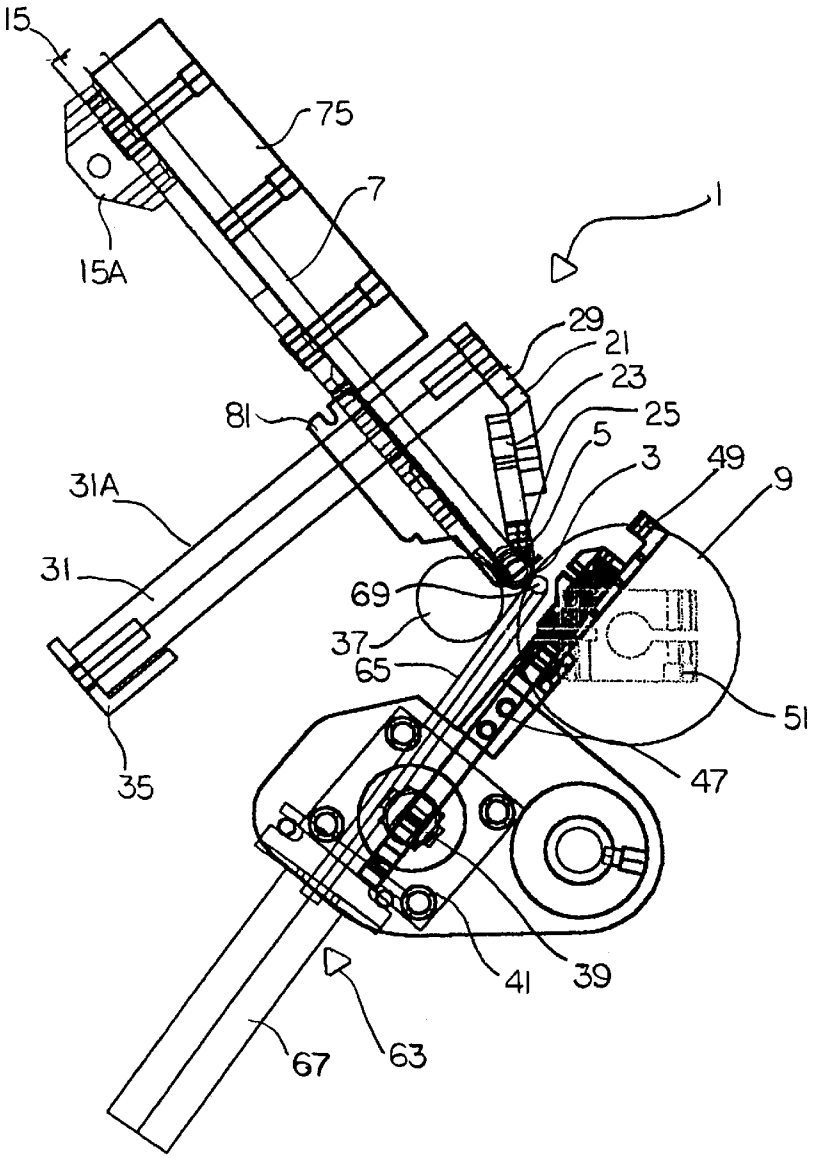
FIG. 6 is a vertical cross section of the platen.
Figure 7:
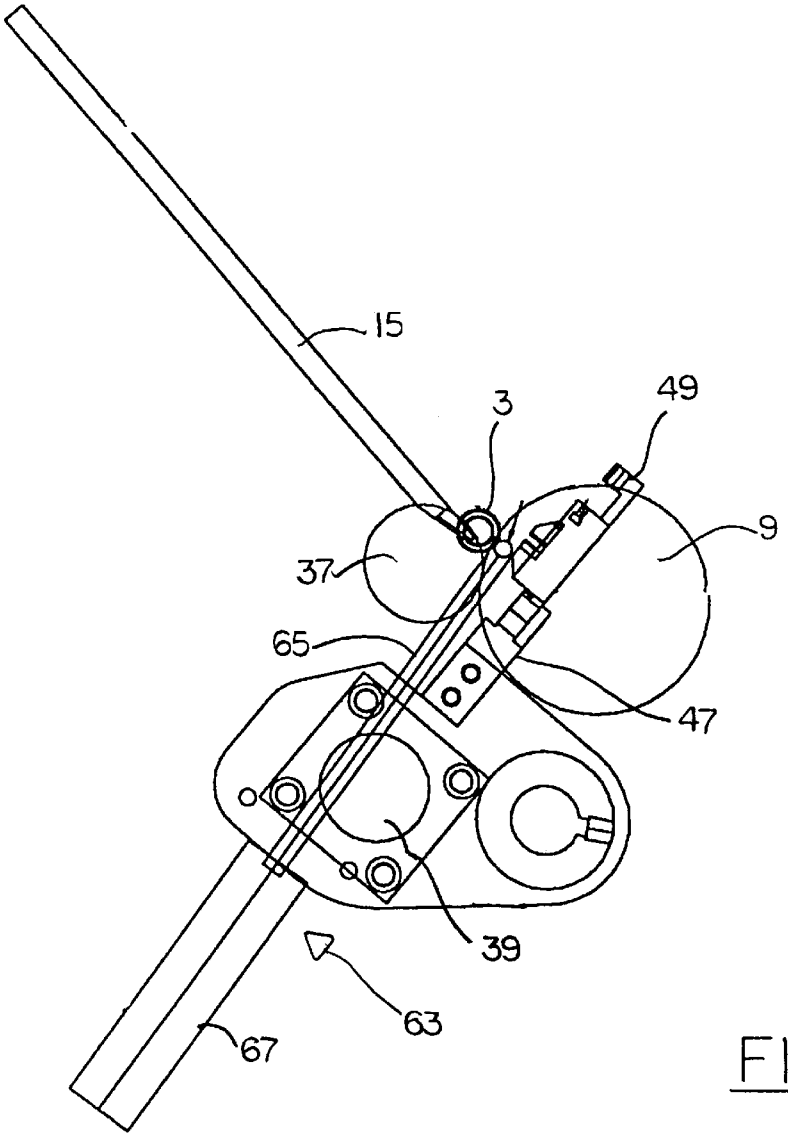
FIG. 7 is a vertical cross section of the platen.
Figure 8:
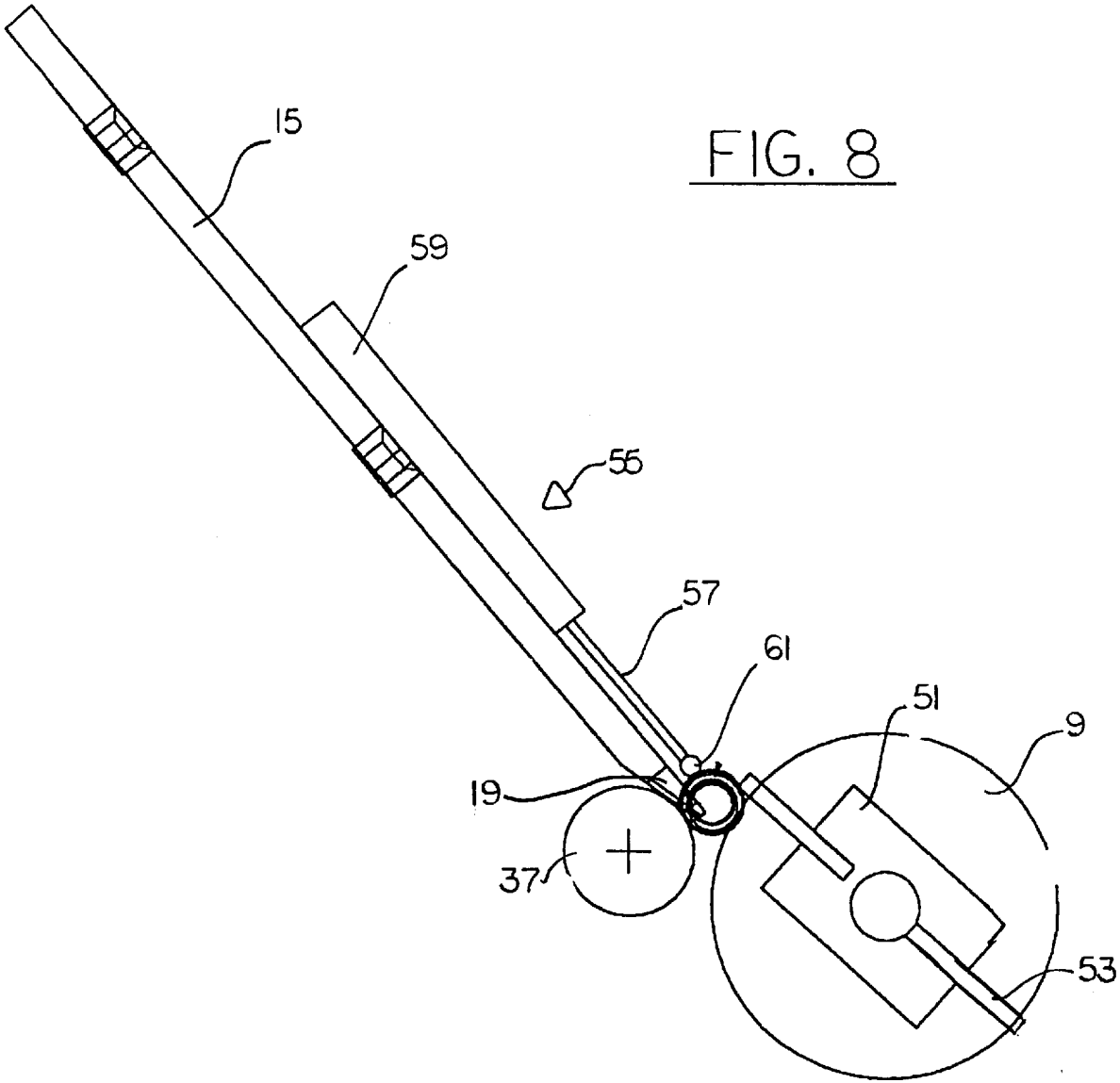
FIG. 8 is a vertical cross section of the platen.

Thus as shown in FIG. 3 spine former members have a width in a direction along the edge which is no greater than the spaces between the forms of the coil so as to allow the coil to pass on either side of the member on the coil is driven along the member substantially without disturbing the coil. Also each spine former member is twisted along the edge to an angle substantially equal to the pitch of the coil.

As the above steps have been completed the operator will replace the remainder of the pre-punched book 5 back into position with the back cover. The operator will manually advance the coil down entire lengths of the books aligned hole 5 by turning the rubber roller, making sure that the coil 3 does not get hung up along the way through the aligned holes 5. At this point the operator will lower the coil support, positioning it out of the way for the next procedure.

The cutting and bending heads 49 must be placed in such a position so that they will cut and bend the first loop of the coil 3 as it enters the book and the last loop of the coil as it exits the book.

The flap members 53 must be arranged into a position as close to the outside edges of the book without coming into contact with the cutting and bending heads 49.

The book clamp comb 25 should be in line with the bottom edge of the book without obstructing any of the punched holes 5. The book clamp comb 25 must be horizontally adjusted so that the spine formers 81A and 81B fit into the wide teeth space 27 of the book clamp comb 25. The coil stop 91 is magnetically placed on a teeth of the platen comb 19 to stop the coil 3 once it has been inserted into the book. The operator places a coil stop on the platen comb teeth in such a position so that when a coil asserted into the book the majority of the excess is to the right of the now bound book.

Having as minimal amount of off cut to the left of the book as possible will result in fewer complications as the off cuts drop away down to the off cut chute.

Since various modifications can be made in my invention as herein above described, and many apparently widely different embodiments of same made within the spirit and scope, it is intended that all matter contained in the accompanying specification shall be interpreted as illustrative only and not in a limiting sense.

What is claimed is:

1. A machine for inserting plastic pre-formed helical coils into aligned holes at an edge of a collated book for binding the book comprising:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

the platen being arranged such that the edge thereof is a bottom edge and such that the platen is inclined upwardly and rearwardly from the drive roller;

and at least one spine former member at the edge of the platen onto which the edge of the book is placed such that the edge of the book rests on the spine former member and the book extends upwardly and rearwardly therefrom, the spine former member having a width in a direction along the edge which is no wider than spaces between the helical turns of the coil so as to allow the coil to pass on either side of the member as the coil is driven along the edge substantially without distorting the coil.

2. The machine according to claim 1 wherein the spine former member is twisted in a direction along the edge to an angle substantially equal to the pitch of the coil.

3. The machine according to claim 1 wherein the spine former member includes a support surface for the edge of the book which is arched to form the edge onto a concave shape approximately matching the curvature of the coil.

4. The machine according to claim 3 wherein the spine former member includes a guide surface opposed to the platen to guide the book edge as it slides down the platen onto the support surface.

5. A machine for inserting plastic pre-formed helical coils into aligned holes at an edge of a collated book for binding the book comprising:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

at least one spine former member at the edge of the platen against which the edge of the book is placed;

and a clamp member opposed to the platen for clamping the book between the clamp member and the platen, the clamp member being located at the spine former member, the clamp member being movable relative to the platen between a first clamp position for clamping the book onto the platen, a second guide position spaced for engaging the book as it slides down between the platen and the clamp member and guiding the edge of the book against the spine former member and a third release position spaced from the platen by a distance sufficient to release the book for removal of the book and the inserted coil from the platen.

6. The machine according to claim 5 wherein the clamp member comprises a bar having an edge substantially aligned with the edge of the platen, the edge of the bar having a guide comb thereon for guiding movement of the coil.

7. The machine according to claim 2 wherein the comb guide at the edge of the platen has a space at the spine former member into which the spine former member fits.

8. The machine according to claim 1 wherein the platen includes a hole therethrough into which an operator can place a hand for manipulating the book on the platen.

9. The machine according to claim 1 wherein the platen is inclined at an angle of approximately 40 degrees from the vertical upwardly and rearwardly from the bottom edge thereof.

10. A machine for inserting plastic pre-formed helical coils into aligned holes at an edge of a collated book for binding the book comprising:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of helical turns of the helical coil along the platen into engagement with the edge of the book and into the aligned holes;

an end stop for halting movement of the coil when inserted such that ends of the coil are exposed at respective ends of the edge of the book;

end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

wherein the platen is adjustable to accommodate different thickness of book by movement of the edge of the platen in a direction toward and away from the drive roller and by adjustment of an angle of inclination thereof relative to a vertical plane containing the coil engagement roller.

11. The machine according to claim 1 wherein the end cutting members are mounted on a shaft at a height below and parallel to the edge of the platen for pivotal movement from a retracted position into engagement with the coil for cutting the coil after insertion.

12. A machine for inserting plastic pre-formed helical coils into aligned holes at an edge of a collated book for binding the book comprising:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of the helical coil along the platen into engagement with the edge of the book and into the aligned holes;

an end stop for halting movement of the coil when inserted such that ends of the coil are exposed at respective ends of the edge of the book;

end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

the coil drive roller being located at a position spaced along the edge of the platen from the end of the edge of the book such that a forward end of the coil is free from the drive roller when it engages the end of the edge of the book;

and a bridge member for supporting the coil in movement from the drive roller to the end of the edge of the book, the bridge member being retractable to allow access by one of the end cutting member to the coil at said end of the edge of the book when the coil is inserted.

13. A machine for inserting plastic pre-formed helical coils into aligned holes at an edge of a collated book for binding the book comprising:

a platen for receiving the collated book, the platen having an edge at which the edge of the book is presented;

a coil engagement roller for engaging the coil at the edge of the platen at a position thereon such that one end of the coil is arranged adjacent to one end of the edge of the book for movement into engagement with the edge of the book;

a coil drive roller for rotating the helical coil;

a comb guide at the edge of the platen such that rotation of the helical coil causes movement of the helical coil along the platen into engagement with the edge of the book and into the aligned holes;

an end stop for halting movement of the coil when inserted such that ends of the coil are exposed at respective ends of the edge of the book;

end cutting members for trimming and crimping both ends of the coil so that the coil is located in the aligned holes at the edge of the book;

the coil drive roller being located at the edge of the platen and having a drive axis about which the coil drive roller rotates substantially parallel to the edge and a peripheral drive surface onto which the coil is placed;

and an assisting drive member for engaging and driving the coil while partly engaged into the edge of the book at a position on the coil at the edge of the book, the assisting drive member comprising at least one intermittent engagement member arranged for rotation about an axis parallel to and adjacent to the coil so as to intermittently contact the coil in a slapping action.

14. The machine according to claim 13 wherein there are at least two intermittent engagement members at spaced positions along the edge of the book.

15. The machine according to claim 13 wherein intermittent engagement member comprises a flap member.

16. The machine according to claim 13 wherein the intermittent engagement member is mounted on a common shaft with the drive roller.

17. The machine according to claim 12 wherein there is provided a pressure member for engaging the coil at the drive roller for pressing the coil into engagement with the drive roller and the engagement roller for driving thereby, the pressure member being retractable to allow the coil to be inserted onto the drive roller and the engagement roller.

18. The machine according to claim 17 wherein movement of the pressure member toward the drive roller is limited to prevent excess compression of the coil at the end causing distortion thereof.

* * * * *

UNITED STATES PATENT AND TRADEMARK OFFICE

CERTIFICATE OF CORRRECTION

PATENT NO. : 6,000,897
DATED : December 14, 1999
INVENTOR(S) : Matthew G. DesJarlais

It is certified that error appears in the above-identified patent and that said Letters Patent is hereby corrected as shown below:

On the title page, item [56] add the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 5 | 5 | 2 | 7 | 1 | 4 | 1 | 6/18/96 | Malmstrom | | | |
| | | 4 | 2 | 4 | 9 | 2 | 7 | 8 | 02 10 81 | Pfaffle | | | |

Signed and Sealed this

Twenty-fifth Day of July, 2000

*Attest:*

*Attesting Officer*

Q. TODD DICKINSON

*Director of Patents and Trademarks*